US007956676B2

(12) United States Patent
Noda

(10) Patent No.: US 7,956,676 B2
(45) Date of Patent: Jun. 7, 2011

(54) SEMICONDUCTOR APPARATUS

(75) Inventor: Ippei Noda, Ohsaka-fu (JP)

(73) Assignee: Ricoh Company, Ltd, Tokyo (JP)

( * ) Notice: Subject to any disclaimer, the term of this patent is extended or adjusted under 35 U.S.C. 154(b) by 473 days.

(21) Appl. No.: 11/724,634

(22) Filed: Mar. 14, 2007

(65) Prior Publication Data

US 2007/0222502 A1 Sep. 27, 2007

(30) Foreign Application Priority Data

Mar. 14, 2006 (JP) ..... 2006-069396

(51) Int. Cl.
*G05F 1/10* (2006.01)

(52) U.S. Cl. ..... 327/540; 327/538; 327/535

(58) Field of Classification Search ..... 327/534–541; 330/255, 253

See application file for complete search history.

(56) References Cited

U.S. PATENT DOCUMENTS

| | | | | |
|---|---|---|---|---|
| 4,464,634 | A * | 8/1984 | Velazquez | 330/264 |
| 5,289,137 | A * | 2/1994 | Nodar et al. | 330/296 |
| 5,880,638 | A * | 3/1999 | Schaffer | 330/255 |
| 6,909,569 | B2 * | 6/2005 | Makita et al. | 360/66 |

FOREIGN PATENT DOCUMENTS

| | | |
|---|---|---|
| JP | 3-204012 | 9/1991 |
| JP | 3817569 | 6/2006 |

* cited by examiner

*Primary Examiner* — Dinh T. Le
(74) *Attorney, Agent, or Firm* — Cooper & Dunham, LLP

(57) ABSTRACT

A semiconductor apparatus includes a constant voltage circuit that converts an input voltage and outputs a prescribed constant voltage. The constant voltage circuit includes an output transistor that receives an input of a control signal and outputs a current (from an input terminal to an output terminal) in accordance with the control signal. Also included is an error amplifier circuit that controls the output transistor to create a voltage in proportion to an output voltage outputted from the output terminal becomes a prescribed reference level. A direct current power source supplies direct current power to the constant voltage circuit. A voltage creating circuit creates and outputs a voltage higher than that of the direct current power.

10 Claims, 3 Drawing Sheets

Prior Art

SEMICONDUCTOR APPARATUS

TECHNICAL FIELD

The present disclosure relates to a semiconductor apparatus having a constant voltage built-in circuit, and in particular to a semiconductor apparatus having such a constant voltage built-in circuit, and receives a low input voltage and creates a small difference between input and output voltages.

DISCUSSION OF BACKGROUND

As a semiconductor becomes finer, an amount of voltage supplied to a semiconductor apparatus decreases, recently. An instrument tends to employ a semiconductor apparatus for the purpose of reducing power consumption. Further, a difference between input and output voltages becomes smaller in order to improve efficiency of a power supply circuit that supplies a power source to a semiconductor apparatus. As shown in FIG. 5, an error amplifier circuit 101 of a conventional constant voltage circuit 100 amplifies a difference between a division voltage Vfb, which is obtained by dividing an output voltage Vo with resistances R101 and R102, and a reference voltage Vref. The error amplifier circuit 101 then controls a gate voltage of an output transistor M101 connected to an output terminal OUT so that the output voltage Vo becomes a prescribed level.

In order to improve efficiency of a constant voltage circuit with the above-mentioned configuration, it is important to decrease a difference between the input and output voltages Vi and Vo as small as possible, and thereby reducing power consumption in the output transistor M101. A difference between input and output voltages Vi and Vo is needed to be more than a product of a turn on resistance and output current of the output transistor M101. When the turn on resistance of the output transistor M101 is large, the difference between the input and output voltages Vi and Vo cannot be decreased. Further, when the voltage supplied to the Semiconductor apparatus decreases, and the input voltage Vi decreases down to approximately a threshold voltage for the output transistor M101 as mentioned above, the output transistor M101 cannot be sufficiently turned on, and thereby the turn on resistance of the output transistor M101 becomes large. Then, in order to decrease the turn on resistance of the output transistor M101, an area of an element of the output transistor M101 is increased or a transistor having a low threshold voltage is utilized.

FIG. 6 illustrates another conventional constant voltage circuit discussed in Japanese Patent Application No. 03-204012, wherein the same numeral numbers and marks represent the same and corresponding parts as in FIG. 5. A constant voltage circuit 100*a* of FIG. 6 includes an output transistor M111 of a source follower connection type using a NMOS transistor, an error amplifier circuit 101, a reference voltage generation circuit 102, a charge pump circuit 103, and a pair of output detection use resistance R101 and R102.

As shown, when a difference between input and output voltages Vi and Vo is small and is less than a threshold voltage for the output transistor M111, the output transistor M111 cannot be turned on. Then, the charge pump circuit creates voltage larger than the input voltage Vi and supplies it to the error amplifier circuit 101 as a power source. Thus, the error amplifier circuit 101 is able to output voltage larger than the input voltage Vi and drive the output transistor M111 even if the difference between the input and output voltages is less than the threshold voltage for the output transistor M111.

However, since a ratio of an area occupied by the output transistor M101 is significantly large in such a constant voltage circuit of FIG. 5, a chip size becomes large when integrated while an element size of the output transistor M101 is increased. Further, an input capacity of a gate of the output transistor M101 also increases, and a high-speed response is not achieved. Further, a MOS transistor having a low threshold voltage usually has a large leak current when turned off sometimes resulting in a problem. Further, since the output transistor M111 includes source follower configuration in the circuit of FIG. 6, an amplification rate is less than one at the output transistor M111, a performance, such as ribble? removal rate, etc., is deteriorated.

BRIEF SUMMARY

Accordingly, an object of the present disclosure is to improve such background arts technologies and provides a new and novel semiconductor apparatus.

Such a new and novel semiconductor apparatus includes a constant voltage circuit that converts an input voltage and outputs a prescribed constant voltage. The constant voltage circuit includes an output transistor that receives an input of a control signal and outputs a current (from an input terminal to an output terminal) in accordance with the control signal. The constant voltage circuit further includes an error amplifier circuit that controls the output transistor to create a voltage in proportion to an output voltage outputted from the output terminal becomes a prescribed reference level. A direct current power source is provided to supply direct current power to the constant voltage circuit. A voltage creating circuit creates and outputs a voltage higher than that of the direct current power. The voltage creating circuit creates a lower voltage than that of a negative side power source of the direct current power source. The lower voltage does not destroy a function of a control electrode of the output transistor. The lower voltage is supplied as a negative side power source voltage of an output stage (an output amplifier circuit) in the error amplifier circuit.

In another embodiment, the lower voltage is supplied to an error amplifier step of the error amplifier circuit as a negative side power source voltage.

In yet another embodiment, the output transistor includes a MOS transistor with its source being grounded.

In yet another embodiment, the output transistor includes a PMOS transistor.

In yet another embodiment, the output transistor includes a PMOS transistor.

In yet another embodiment, a difference between the voltage created by the voltage creating circuit and the voltage inputted to the output transistor is controlled to be less than an absolute maximum rated value of the voltage induced between the gate and the source of the output transistor.

BRIEF DESCRIPTION OF DRAWINGS

A more complete appreciation of the subject matter of the present disclosure and many of the attendant advantages thereof will be readily obtained as the same becomes better understood by reference to the following detailed description when considered in connection with the accompanying drawings, wherein.

DISCUSSION OF PREFERRED EMBODIMENTS

Figure 1:
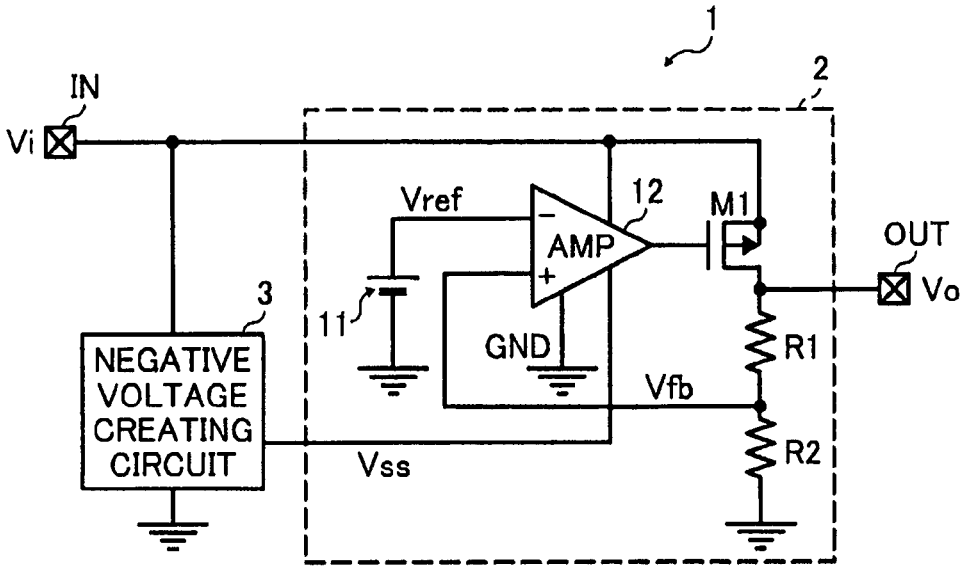
FIG. 1 illustrates an exemplary interior configuration of a semiconductor apparatus according to a first embodiment of the present disclosure.

Referring now to the drawing, wherein like reference numerals designate identical or corresponding parts throughout several views, in particular in FIG. 1, an exemplary interior configuration of a semiconductor apparatus according to the first embodiment of the present disclosure is described.

As shown, the semiconductor apparatus 1 includes a constant voltage circuit 2 that creates a prescribed constant voltage based on an input voltage Vi inputted to an input terminal IN and outputs it from an output terminal OUT as an output voltage Vo. The semiconductor apparatus 1 also includes a negative voltage creating circuit 3 that creates a prescribed negative voltage Vss based on the input voltage Vi, and supplies it to the constant voltage circuit 2. Such a negative voltage creating circuit 3 serves as a voltage creating circuit.

The constant voltage circuit 2 includes a reference voltage creating circuit 11 that creates and outputs a prescribed reference voltage Vref, an error amplifier circuit 12, an output transistor M1 having a PMOS transistor, and a pair of output voltage detection use resistances R1 and R2, (i.e., a voltage divider). The output transistor M1 is inserted between the input and output terminals IN and OUT. Whereas, the pair of resistances R1 and R2 are serially connected between the output terminal OUT and ground voltage GND. A division voltage Vfb obtained by diving the output voltage Vo is outputted from a connection section between the resistances R1 and R2, and is inputted to a non-inversion input terminal of the error amplifier circuit 12. The reference voltage Vref is inputted to an inversion input terminal of the error amplifier circuit 12. An output terminal of the error amplifier circuit 12 is connected to a gate of the output transistor M1. Further, the negative voltage creating circuit 3 includes a publicly known power source circuit using a charge pump circuit or the like. The negative voltage Vss outputted from the negative voltage creating circuit 3 is inputted to the error amplifier circuit 12.

Figure 2:
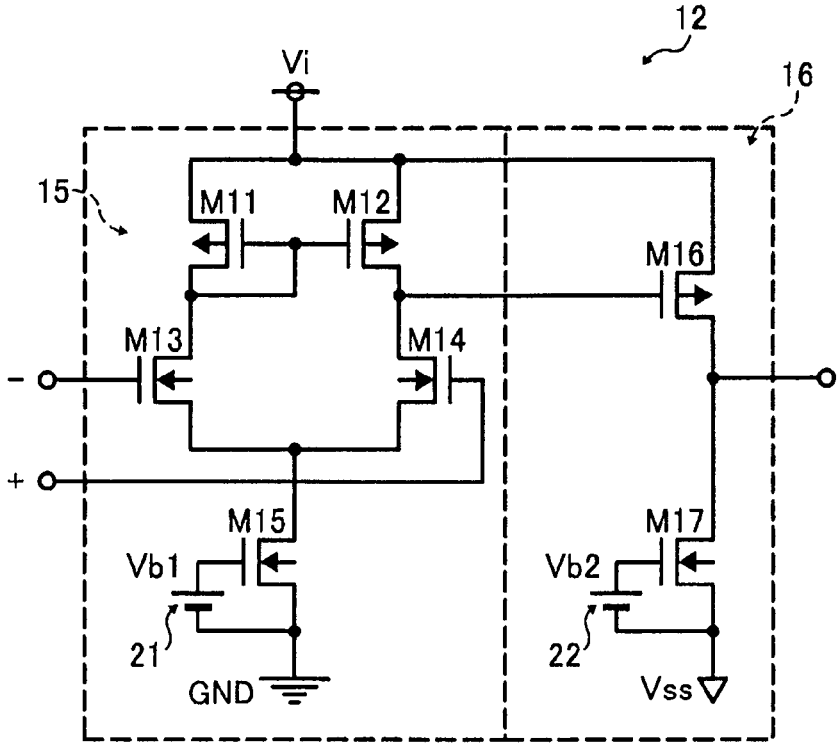
FIG. 2 illustrates an exemplary error amplifier circuit 12 shown in FIG. 1.

FIG. 2 illustrates one example of the error amplifier circuit shown in FIG. 1.

As shown, the error amplifier circuit 12 includes a differential amplifier circuit 15 and an output amplifier circuit 16. The differential amplifier circuit 15 includes a pair of PMOS transistors M11 and M12, a plurality of NMOS transistors M13 to M15, and the first bias power source 21 that creates and outputs a prescribed bias voltage Vb1. The output amplifier circuit 16 includes a PMOS transistor M16, a NMOS transistor M17, and the second bias power source 22 that creates and outputs a prescribed bias voltage Vb2. To the respective differential amplifier circuit 15 and the output amplifier circuit 16, the input voltage Vi is inputted as positive side power source voltage. Further, as negative side power source voltages, ground voltage GND is inputted to the differential amplifier circuit 15, and the negative voltage Vss is inputted to the output amplifier circuit 16, respectively. Such an output amplifier circuit serves as an output stage.

The NMOS transistors M13 and M14 collectively form a differential pair, while respective sources are connected to each other. The NMOS transistor M15 is connected to a position between a connection section between the sources of the NMOS transistors M13 and M14 and ground voltage GND. To the gate of the NMOS transistor M15, the bias voltage Vb1 is inputted as a constant current source. The PMOS transistors M11 and M12 collectively form a current mirror circuit, and function as a load for the NMOS transistors M13 and M14. The respective sources of the PMOS transistors M11 and M12 are connected to the input voltage Vi. The respective gates of the PMOS transistors M11 and M12 are connected to each other and are connected to the drain of the PMOS transistor M11.

The drain of the PMOS transistor M11 is connected to the drain of the NMOS transistor M13, while the drain of the PMOS transistor M12 is connected to the drain of the NMOS transistor M14. The connection section serves as an output terminal of the differential amplifier circuit 15 and is connected to the gate of the PMOS transistor M16. The gate of the NMOS transistor M13 serves as the inversion input terminal of the error amplifier circuit 12, while the gate of the NMOS transistor M14 serves as the non-inversion input terminal of the error amplifier circuit 12. PMOS and NMOS transistors M16 and M17 are serially connected between the input voltage Vin and the negative voltage Vss. The bias voltage Vb2 is inputted to the gate of the NMOS transistor M17. Thus, the NMOS transistor M17 serves as a constant current source. The connection section of the PMOS and NMOS transistors M16 and M17 serves as the output terminal of the error amplifier circuit 12.

In such a configuration, the error amplifier circuit 12 controls output current of the output transistor M1 so that the division voltage Vfb becomes a reference voltage Vref and the output voltage Vo becomes constant at a prescribed level. Further, since a difference between input and output voltages of the output transistor M1 can be more decreased when the turn on resistance of the output transistor M1 is decreased, electric power loss can be reduced in the output transistor M1. Further, since a compact type can be employed for the output transistor M1 when the same turn on resistance can be employed, a chip area can be reduced, a response speed is improved, and phase compensation can readily be achieved. Further, when the output transistor M1 employs source ground connection to have a gain, a libulu? removal rate can be improved. As a result, the semiconductor apparatus can be manufactured at low coat, and performance can be improved. Thus, the turn on resistance of the output transistor M1 needs to be decreased.

Figure 3:
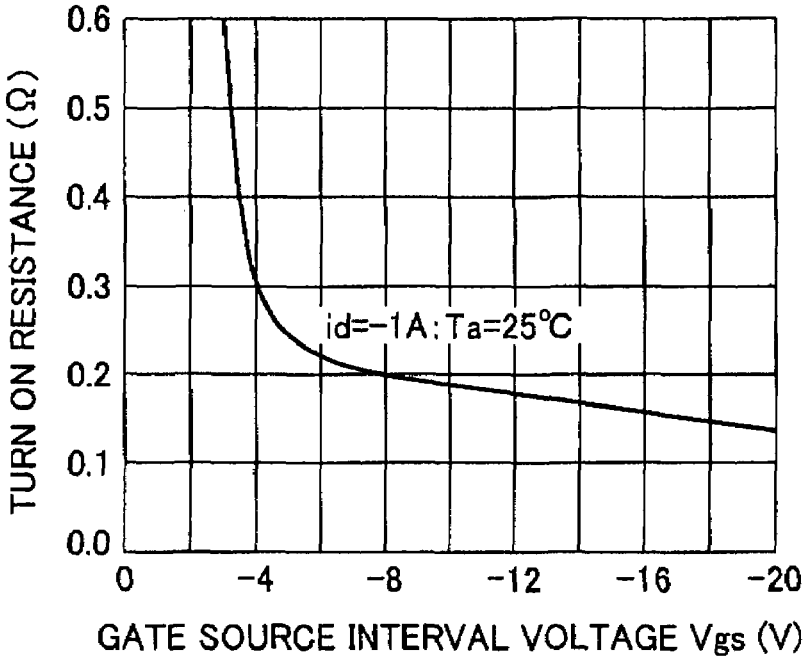
FIG. 3 illustrates an exemplary relation between a gate-source interval voltage Vgs and a turn on resistance in a PMOS transistor.

FIG. 3 illustrates an exemplary relation between a gate-source interval voltage Vgs and a turn on resistance in a PMOS transistor, wherein a drain current id of the output transistor M1 is −1 A, and a channel temperature Ta thereof is 25 centigrade. As shown, a turn on resistance sharply decreases on condition that the gate source interval voltage Vgs is approximately −4 v.

Whereas, the turn on resistance gradually decreases down to −20 v as the absolute maximum rated value for the gate source interval voltage Vgs. Specifically, the turn on resistance, which is 0.3 ohm when the gate source interval voltage Vgs is −4V, decreases down to less than half (i.e., 0.13 ohm) when it is −20V. This represents that when the gate source interval voltage Vgs is increased, voltage can descend to less than half in the output transistor M1.

Figure 4:
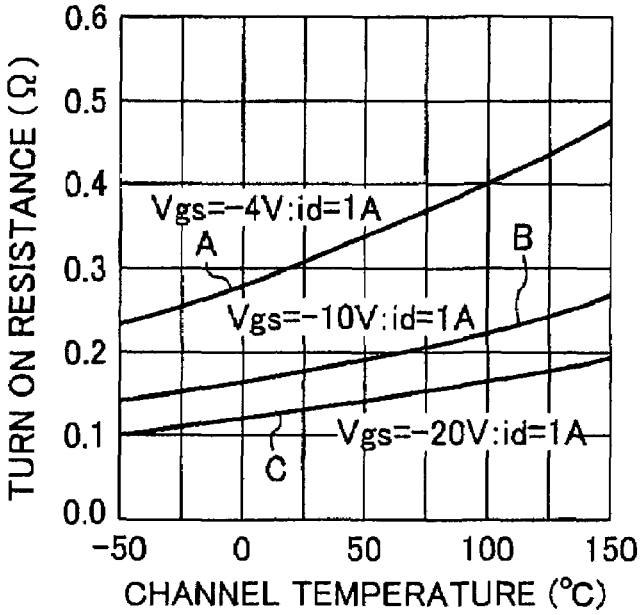
FIG. 4 illustrates an exemplary temperature performance of the turn on resistance in the PMOS transistor.
Figure 5:
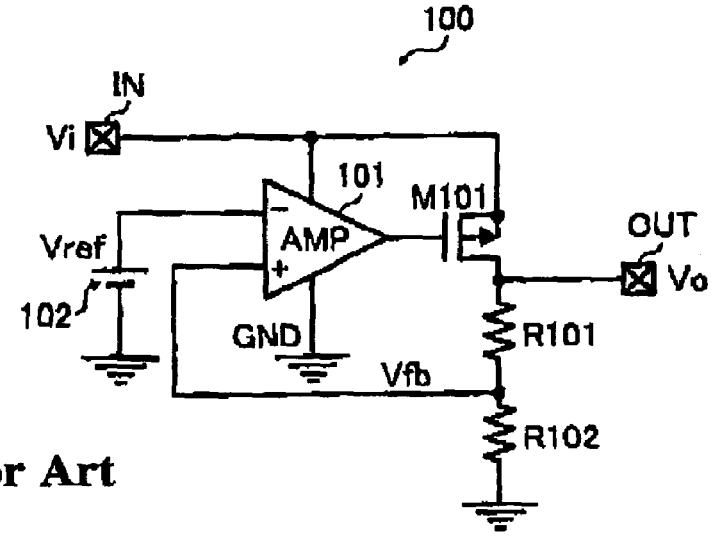
FIG. 5 illustrates a conventional constant voltage circuit.
Figure 6:
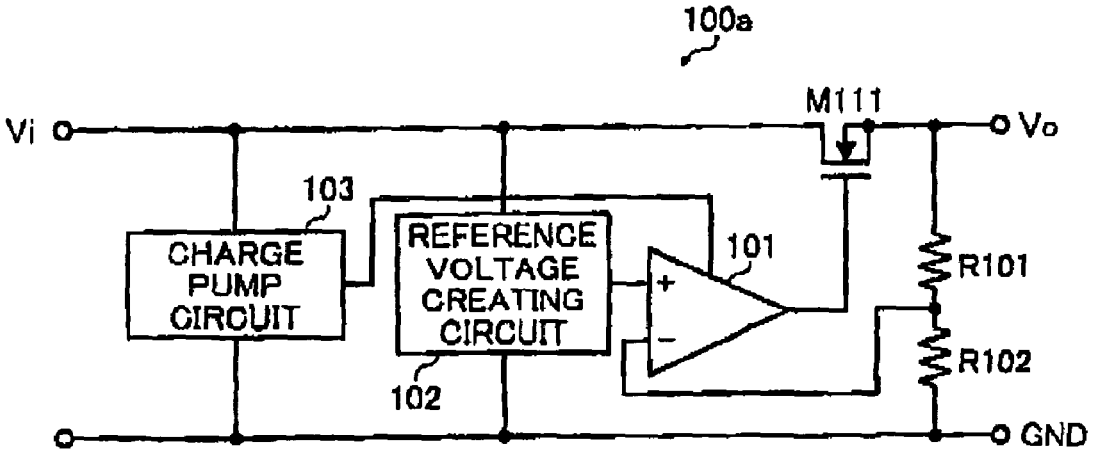
FIG. 6 Prior Art
FIG. 6 illustrates another conventional constant voltage circuit.

FIG. 4 illustrates an exemplary temperature performance of the turn on resistance of the PMOS transistor, wherein "A" represents a case when a gate source interval voltage Vgs is −4V, "B" represents a case when a gate source interval voltage Vgs is −10V, and "C" represents a case when a gate source interval voltage Vgs is −20V. It is understood therefrom that the larger the gate source interval voltage Vgs, the smaller the change in a turn on resistance in accordance with temperature. The similar tendency can be seen in a N-channel type power MOS transistor (NMOS transistor) and a MOS transistor having different rated current or power, as well as in a MOS transistor integrated with the other circuit on a semiconductor substrate to that of the PMOS transistor in FIGS. 3 and 4.

As shown in FIGS. 1 and 2, a voltage varying from the input voltage Vi to the negative voltage Vss is outputted from the output terminal of the error amplifier circuit 12. Thus, by setting a voltage difference between the input voltage Vi and the negative voltage Vss to be slightly less than an absolute maximum rated value of the gate source interval voltage of the output transistor M1, the output transistor M1 can be driven without being broken while the turn on resistance approximates the minimum.

Further, a difference between input and output voltages of the constant voltage circuit 2 can be decreased, and power source can efficiency be improved. Further, when the turn on resistance of the output transistor M1 does not need to be decreased, an IC-chip can be downsized at low cost, because the output transistor M1 can be small. Further, since a gate input capacity of the output transistor M1 decreases, a response speed of the output transistor M1 can be increased.

Even though ground voltage is used as a negative side power source voltage for the output amplifier circuit 16, the negative voltage Vss outputted from the negative voltage creating circuit 3 can be used as the negative side power source voltage for the differential amplifier circuit 15.

Numerous additional modifications and variations of the present disclosure are possible in light of the above teachings. It is therefore to be understood that within the scope of the appended claims, the present disclosure may be practiced otherwise that as specifically described herein.

This application claims priority under 35 U.S.C. §119 to Japanese Patent Application No. 2006-069396 filed on Mar. 14, 2006, the entire contents of which are hereby incorporated herein by reference.

What is claimed is:

1. A semiconductor apparatus, comprising:

a constant voltage circuit configured to receive an input voltage through an input terminal and output a prescribed constant voltage through an output terminal, said constant voltage circuit including an output transistor configured to receive a control signal and cause an output current to flow from said input terminal to said output terminal in accordance with the control signal, said constant voltage circuit further including an error amplifier circuit including an output amplifier circuit supplied with a negative side power source voltage and supplied with the input voltage as a positive side power source voltage, and configured to control the output transistor to allow said output current to flow so that an output voltage at the output terminal is in proportion to a reference voltage and becomes constant at a prescribed reference level;

a direct current power source including a positive side terminal and a negative side terminal and configured to supply direct current power to the constant voltage circuit; and a voltage creating circuit configured to output a negative voltage higher in magnitude than that of the direct current power;

wherein said negative voltage from said voltage creating circuit is a lower voltage than that at the negative side terminal of the direct current power source;

wherein a difference between said input voltage and said negative voltage minimizes a turn-on resistance of the output transistor, and wherein said negative voltage from the voltage creating circuit is supplied as said negative side power source voltage of said output amplifier circuit in the error amplifier circuit.

2. The semiconductor apparatus as claimed in claim 1, wherein said error amplifier circuit further includes a differential amplifier circuit supplied with a negative side power source voltage and with the input voltage as a positive side power source voltage, and said negative voltage is supplied to said differential amplifier circuit of the error amplifier circuit as the negative side power source voltage of the differential amplifier circuit.

3. The semiconductor apparatus as claimed in claim 2, wherein said output transistor includes a MOS transistor, and wherein a source of said MOS transistor is grounded.

4. The semiconductor apparatus us claimed in claim 3, wherein a difference between the negative voltage of said voltage creating circuit and the voltage inputted to said output transistor is controlled to be less than on absolute maximum rated value of a gate-source voltage between a gate and a source of the output transistor.

5. The semiconductor apparatus as claimed in claim 1, wherein said output transistor includes a MOS transistor, and wherein a source of said MOS transistor is grounded.

6. The semiconductor apparatus as claimed in claim 5, wherein a difference between the negative voltage of said voltage creating circuit and the voltage inputted to said output transistor is controlled to be less than an absolute maximum rated value of a gate-source voltage between a gate and a source of the output transistor.

7. The semiconductor apparatus as claimed in claim 1, wherein said output transistor includes a PMOS transistor.

8. The semiconductor apparatus as claimed in claim 7, wherein a difference between the negative voltage of said voltage creating circuit and the voltage inputted to said output transistor is controlled to be less than an absolute maximum rated value of a gate-source voltage between a gate and a source of the output transistor.

9. The semiconductor apparatus as claimed in any one of claim 2, wherein said output transistor includes a PMOS transistor.

10. The semiconductor apparatus as claimed in claim 9, wherein a difference between the negative voltage of said voltage creating circuit and the voltage inputted to said output transistor is controlled to be less than an absolute maximum rated value of a gate-source voltage between a gate and a source of the output transistor.

* * * * *